US006716098B2

(12) United States Patent
Brown et al.

(10) Patent No.: US 6,716,098 B2
(45) Date of Patent: Apr. 6, 2004

(54) COIN PICK UP WHEELS

(75) Inventors: Terry Brown, Victoria Point (AU); Roy Allan Leo Austin, Slacks Creek (AU); Christopher Douglas Brown, Victoria Point (AU); Andrew John Drysdale, Victoria Point (AU)

(73) Assignee: Queensland Motorways Limited, Murrarie (AU)

( * ) Notice: Subject to any disclaimer, the term of this patent is extended or adjusted under 35 U.S.C. 154(b) by 175 days.

(21) Appl. No.: 09/993,923

(22) Filed: Nov. 24, 2001

(65) Prior Publication Data

US 2002/0106984 A1 Aug. 8, 2002

(51) Int. Cl.[7] ..... G07D 5/08
(52) U.S. Cl. ..... 453/12; 221/277
(58) Field of Search ..... 453/33, 34, 35, 453/49, 12, 57; 221/169, 277

(56) References Cited

U.S. PATENT DOCUMENTS 5,240,099 A * 8/1993 Brown et al. ..... 194/317
5,607,351 A * 3/1997 Schwartz ..... 453/32
5,988,348 A * 11/1999 Martin et al. ..... 194/317
2002/0061725 A1 * 5/2002 Kurosawa ..... 453/13

FOREIGN PATENT DOCUMENTS

AU 645548 10/1991

* cited by examiner

*Primary Examiner*—Donald P. Walsh
*Assistant Examiner*—Kenneth W Bower
(74) *Attorney, Agent, or Firm*—Fredrikson & Byron, PA

(57) ABSTRACT

A coin pick up wheel for a coin receiving and validating apparatus, said pick up wheel comprising a disc-like body having a plurality of circumferentially spaced coin receiving recesses each recess including a chamfered edge portion extending at least partially about an upper edge thereof, said disc-like body having a central hub portion and an annular outer portion, said pick up wheel characterized in that said disc-like body is formed from a cross linked high molecular weight polyethylene polymer or co-polymer and further characterized in that said annular outer portion tapers convergently towards an outer edge of said disc-like body.

14 Claims, 2 Drawing Sheets

COIN PICK UP WHEELS

FIELD OF THE INVENTION

This invention is concerned with improvements in coin pick up wheels used in receiving and validation apparatus of the type typically employed at toll stations on tolled roadways.

The invention is concerned particularly with improvements to coin pick up wheels for use in the coin receiving and validation apparatus as described in Australian Patent No. 645548.

BACKGROUND OF THE INVENTION

The coin receiving and validation apparatus of Australian Patent No. 645548 comprises a coin acceptor mechanism having a disc-like coin pick up wheel with a planar upper surface and spaced coin recesses about its periphery. The pick up wheel is rotatably mounted on an annular base which is inclined at an angle of about 45° to vertical.

Coins or tokens of various denominations are directed to a coin hopper mounted over the lower region of the coin receiver and coins are collected in the coin recesses as the pick up wheel rotates. As the wheel rotates it carries each coin past an electromagnetic validation sensor located in the base, the sensor being coupled to a solenoid actuated reject mechanism for rejecting invalid coins.

The description of Australian Patent No. 645548 states that the validation sensor is located intermediate the ends of a rebated channel at the uppermost region of the annular base. When the coins drop into the rebated channel they are urged past the sensor by a tapered leading edge of a rib extending from the undersurface of the coin pick up wheel. The front end of each rib is tapered so that a portion of the leading edge thereof will always engage a coin, regardless of size, in the rebated channel to ensure that coins are stably held as they roll or are pushed along the rebated channel for coin validation.

While the primary purpose of the rebated channel is stated to be for the stabilization of small coins as they are moved past the coin validation to ensure accurate detection, current coin receiving and validation apparatus marketed by the patentee does not include a recessed channel in the annular base nor does it include a rib on the back of the coin pick up wheel. Current models of coin receiving and validation apparatus have a coin pick up wheel with a planar rear face resting directly against the planar face of the base.

Once a coin is validated it is directed to an aperture in the annular base to fall under the influence of gravity into a coin collector.

The disc-like coin pick up wheel and the annular base are made from a very rigid polyurethane polymer to resist wear from coins.

Although generally effective for their intended purpose, the pick up wheels of the coin receiving and validation apparatus of Australian Patent No. 645548 do however suffer a number of problems in practice, The main problem is the inability of the pick up wheel to reliably handle small coins such as an Australian five-cent piece or an American dime. These small coins tend to jam between the coin pick up wheel and the annular base necessitating attention by a maintenance operator to remove the pick up wheel to access the jammed coin. Typically clearance of a coin jammed apparatus takes about twenty minutes thus necessitating closure of the toll lane for that period.

In busy periods closure of one or more toll lanes for twenty minutes not only reduces daily toll revenue but also can restrict overall traffic flow on the tollway as motorists are directed into fewer toll lanes.

Investigations revealed that in some instances, coin jams were due to buckling of the original coin pick up wheels at ambient temperatures in excess of about 30° C. This means that coin jams are likely to be more frequent at certain times of the days during hotter seasons or in certain geographical regions. These original pick up wheels were constructed with a central boss with radially extending stiffening ribs on the undersurface thereof.

Another cause of coin jams results from a build up of material between the coin pick up wheel and the annular base. Over time, a grey, greasy deposit builds up on either or both of the adjacent surfaces of the coin pick up wheel and the annular base. This deposit comprises a particulate abrasion residue from the polyurethane material of which the pick up wheel and annular base are comprised and initially is derived from abrasion between coins and those elements. The abrasive particulate polyurethane material then combines with contamination from the coins to form the greasy deposit.

As the deposit layers build, this increases the friction between the polyurethane components and thus the rate of wear. This deposit build up in turn causes the peripheral edges of the pick up wheel to warp upwardly forming a gap which can entrap small coins between the pick up wheel and the annular base. At least the pick up wheel is believed to be comprised of a thermoplastic polyurethane polymer.

Attempts to increase the traffic throughput in toll lanes by increasing the pick up wheel speed above the manufacturers recommended maximum of 37–38 rpm have caused thermal distortion of the coin pick up wheel and thus coin jamming, as a direct result of increased friction between the pick up wheel and the annular base.

The other main problem associated with the apparatus of Australian Patent No. 645548 is the cost and inconvenience in frequent replacement of worn coin pick up wheels which typically last only for about 100,000 to 150,000 transactions, each transaction representing an average receipt of 3 coins.

Apart from the periodic thermal warping due to ambient temperature conditions and/or the warping due to deposit build ups, the problem of coin jamming is exacerbated by wear in the coin pick up wheels, which have an initial thickness of only about 20 mm. As the thin pick up wheel wears, its thickness diminishes making it less resistant to thermal warping or warping due to deposit build-ups.

Even if one was to disregard the cost of the replacement pick up wheel, the cost of replacement at frequent intervals includes toll lane downtime of about twenty minutes and the resultant loss of toll revenue.

The more recent prior art pick up wheels typically comprised an injection or compression molded disc about 250 mm in diameter with a planar upper surface and a central hub about 150 mm in diameter. Typically, the hub was a solid member about 13 mm thick while the annular outer portion of the pick up wheel was about 2 mm thick with a 90° shoulder between the edge of he central hub and the lower surface of the annular outer portion of the pick up wheel.

The later wheels appear to be fabricated from a rigid thermosetting polyurethane material which exhibits thermal stability up to about 200° C. however these later wheels are still subject to buckling or warping with consequent jamming of small coins under conditions of elevated humidity.

It is considered that the propensity to buckling or warping is a function of differential expansion between the upper and lower surfaces of the coin pick up wheel due to moisture absorption by the polymeric material at the exposed upper facer of the solid central hub and the much thinner annular outer portion.

These later wheels also have a life expectancy of about 100,000 to 150,000 transactions due to wear in the pick up wheel which manifests itself as a reduced capacity to pick up and or retain thicker coins as the pick up wheel rotates. This reduced pick up and retention capacity in turn translates to slower transactional processing equivalent to a reduced pick up wheel rotational speed.

Accordingly, there is a need to provide an Improved coin pick up wheel for the apparatus of Australian Patent No. 645548 which pick up wheel is less susceptible to coin jamming problems and is otherwise more durable in service.

BRIEF DESCRIPTION OF THE DRAWINGS

According to one aspect of the invention there is provided a coin pick up wheel for a coin receiving and validating apparatus, said pick up wheel comprising:

a disc-like body having a plurality of circumferentially spaced coin receiving recesses each recess including a chamfered edge portion extending at least partially about an upper edge thereof, said disc-like body having a central hub portion and an annular outer portions said pick up wheel characterised in that said disc-like body is formed from a cross linked high molecular weight polyethylene polymer or co-polymer and further characterised in that said annular outer portion tapers convergently towards an outer edge of said disc-like body.

Suitably said central hub portion includes a boss-like projection extending from a lower face thereof.

Preferably said central hub portion is adapted for mounting to a drive shaft for rotation therewith by at least four equally spaced fasteners extending through said central hub portion. if required said central hub portion may include a planar upper surface portion.

Suitably the disc-like body is formed by a machining process.

The coin receiving recesses may have an inner edge with a thickness in the range of 0.9 mm to 1.3 mm.

Preferably the coin receiving recesses have an inner edge with a thickness in the range 1.0 mm to 1.2 mm.

Most preferably the inner edge of said coin receiving recesses is in the range 1.05 mm to 1.11 mm.

If required the chamfered edge portion of each coin receiving recess extends to an outer edge of said disc-like body at a leading edge of said recess relative to a direction of rotation of said disc-like body.

Suitably, each coin receiving recess comprises a generally concave arcuate inner edge having a plurality of differing radii.

The differing radii of each coin receiving recess may have the same or differing points of origin.

Preferably, said leading edge is formed at a free end thereof as a tangent to an adjacent arcuate edge portion.

If required the differing radii of each coin receiving recess correspond with differing radii of coins receivable by said coin receiving and validating apparatus.

Preferably a radiussed inner edge portion corresponding to a smallest coin is located adjacent a trailing edge of a coin receiving recess opposite said leading edge.

BRIEF DESCRIPTION OF THE DRAWINGS

Figure 1:
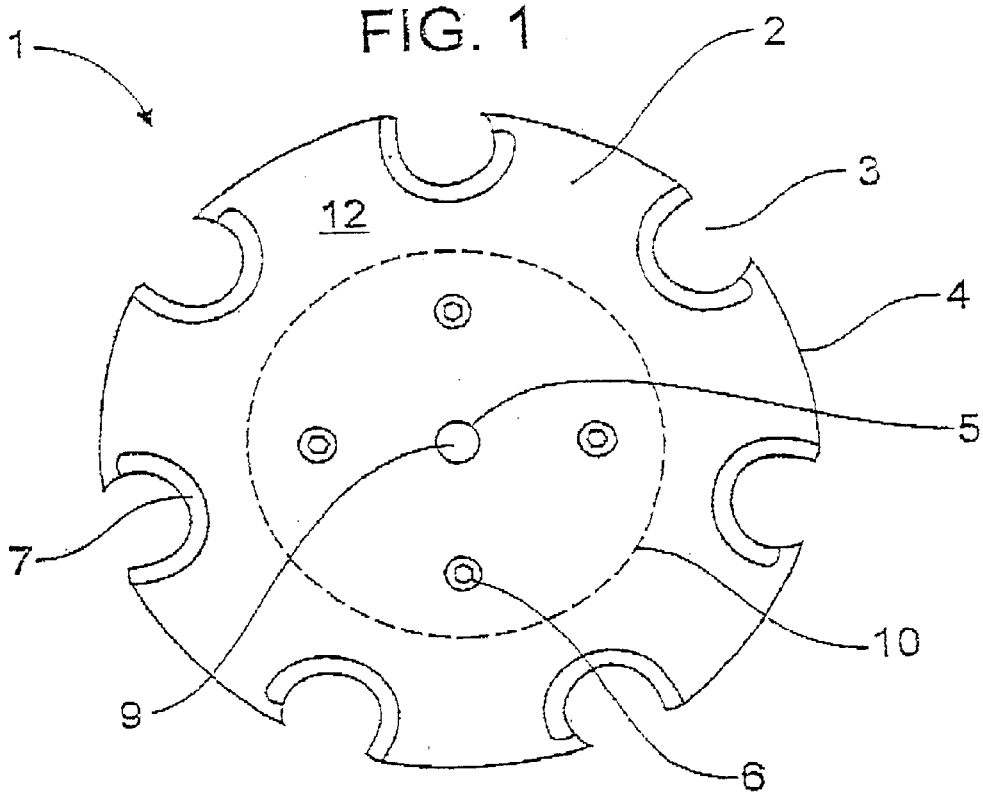

In order that the invention may be more readily understood and put into practical effect, reference will now be made to a preferred embodiment illustrated in the accompanying drawings in which:

FIG. 1 shows a top plan view of a coin pick up wheel according to the invention.

Figure 2:
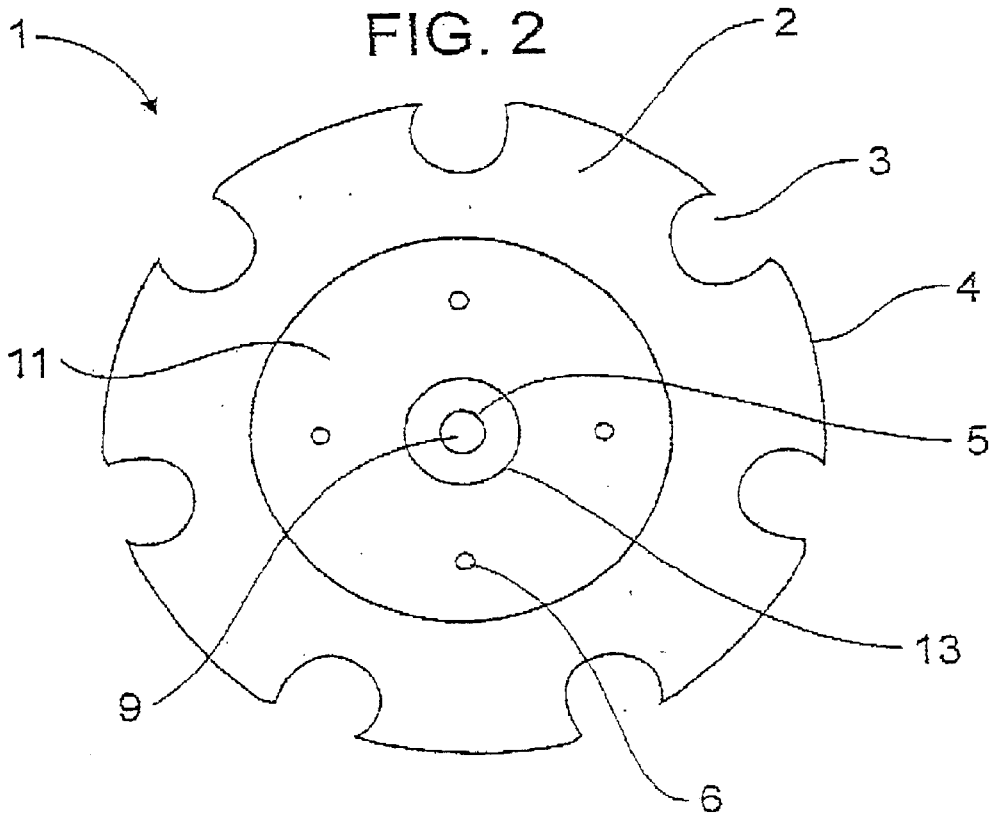

FIG. 2 shows a bottom plan view of the wheel of FIG. 1

Figure 3:
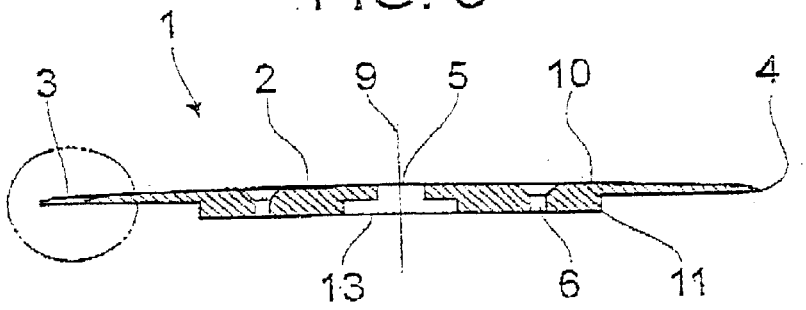

FIG. 3 shows a diametric cross-sectional view of the wheel of FIGS. 1 and 2.

Figure 4:
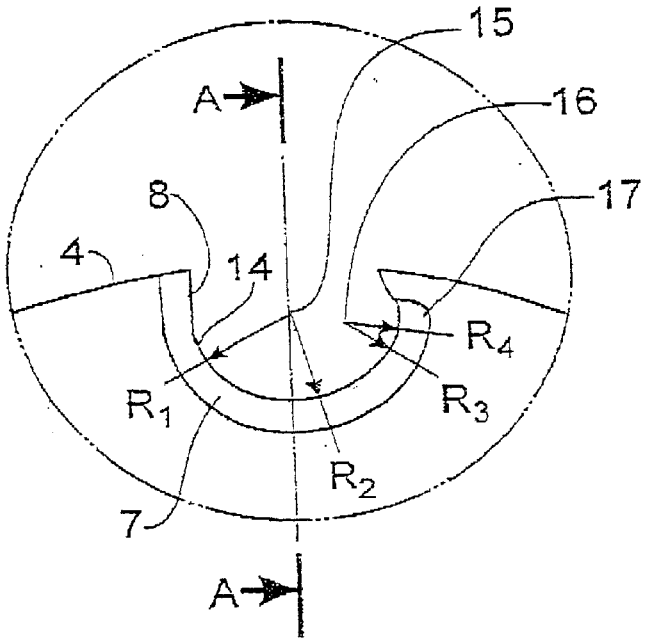

FIG. 4 shows an enlarged view of the encircled region relating to a coin receiving recess.

Figure 5:
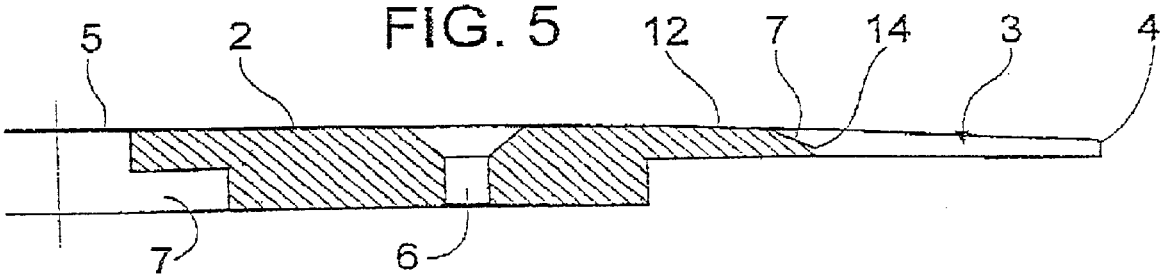

FIG. 5 is a part cross-sectional view through A—A in FIG. 4.

As shown in FIGS. 1–3, coin pick up wheel 1 comprises a disc-like body 2 having a plurality of coin receiving recesses 3 formed in an outer edge 4 of body 2. A central aperture 5 locates over a drive shaft (not shown) for rotation of the pick up wheel 1. Apertures 6 are provided for mounting screws (not shown) to secure pick up wheel 1 to a mounting flange (not shown) associated with the drive shaft (also not shown).

Body 2 is machined from a sheet of readily available, cross-linked high molecular weight polyethylene (HMWPE). This polymer is known to possess good thermal and mechanical stability, resistance to chemicals and low water absorption as well as abrasion resistance thus making it well suited to this application.

Formed about the major part of the periphery of recesses 3 are chamfered edges 7 to assist in the coin pick up process. In contrast to prior art pick up wheels, the chamfered edge 7 extends right to the outer edge of body 2 at the leading side of each recess 3 having regard to the direction of rotation of wheel 1. Immediately adjacent outer edge 4, the leading edges 8 of recesses 3 extend generally tangentially of an immediately adjacent arcuate portion. The leading edges 8 may extend radially of s rotational axis 9 if required.

As shown more clearly in FIG. 3, a central region shown by phantom boundary 10 is generally planar and parallel to the lower surface of boss like projection 11 there beneath. The annular outer portion 12 between boundary 10 and edge 4 tapers convergently outwardly on the upper surface thereof, again in contrast to prior art coin pick up wheels having a generally planar top surface over the entire top of the pick up wheel.

FIGS. 2 and 3 show a shouldered recess 13 under aperture 5 to receive a shouldered portion (not shown) of the pick up wheel drive shaft (also not shown).

FIG. 4 shows an enlarged view of a coin receiving recess in the region encircled in FIG. 3.

The arcuate inner edge 14 of each recess is divided into regions having differing radii of curvature.

Between the leading edge 8 and about the middle region of edge 14 are radii $R_1$ and $R_2$, each sharing the same origin 15. Between radiussed region $R_2$ and the end 17 of chamfered edge 7 located inwardly of edge 4 are radii $R_3$ and $R_4$, each sharing another origin 16. Radii $R_1$, $R_2$, $R_3$ and $R_4$ are chosen to seat, say, an Australian coin set comprising a 50 cent coin, a 20 cent coin, a 10 cent coin, a one dollar coin, a 2 dollar coin and a 5 cent coin, the 2 dollar coin and the 5 cent coin being of approximately the same diameter although significantly different in thickness. The 10 cent coin and the one dollar coin also have a similar diameter. In the embodiment shown, the region represented by radius $R_4$ is suited to reliably pick up and supportably locate 5 cent and two dollar coins as the coin wheel rotates, FIG. 5 shows a cross sectional view through A—A in FIG. 4 and shows clearly the shouldered inner edge 14 of recess 3 for support of coins thereon as the coin pick up wheel rotates.

The selection of the number of radiussed regions of a coin receiving recess, the specific radii employed, the width and angle of chamfered edges 7 and the thickness of edge 14 is made according to the range of radii and thickness of coinage which may be encountered according to geographical location.

Coin pick up wheels according to the present invention are considered to offer substantially improved performances over prior art pick up wheels. initial wear tests suggest that up to or even in excess of 1,000,000 transactions may be achievable with coin pick up wheels according to the invention. This is up to six times the duty cycle of a typical prior art wheel.

Pick up wheels according to the invention have been shown to be physically and chemically stable over a wide range of temperatures and relative humidities, even when rapid changes in temperature and humidity occur. In prior art pick up wheels, certain values of temperature and humidity and rapid changes therein would manifest themselves in buckling or warping of the outer annular coin pick up region thus permitting thin coins intermittently to jam between the pick up wheel and the support base upon which it rotates. Trials conducted to date show no coin jamming with pick up wheels according to the invention.

Whilst not wishing to be bound by any particular theory or conjecture, it is believed that at least part of the physical stability of coin pick up wheels may be due to a surface stress relieving action which occurs under normal conditions of use. When a premolded or extruded sheet of commercially available cross linked high molecular weight polyethylene (HMWPE) is machined to the required shape, it is believed that a relatively high level of stress is accumulated in the outer surface (at least) of the coin pick up wheel so produced. This surface stress may give rise to buckling or warping in other polymeric materials and attempts to relieve this stress in, say, a molded cross linked polyurethane wheel by annealing at elevated temperatures can cause buckling as a result of stress relief.

In the case of the present invention, constant impacts of coins against the wheel is considered to be mechanically similar to a shot peening process used to relieve surface stresses in molded and machined metal parts and this may contribute to the reduced tendency to buckling or warping.

Yet another improvement noted in coin pick up wheels according to the invention is the high level of pick up reliability. If, due to inefficient coin wheel geometry, each successive coin receiving recess is not occupied by a coin during rotation of the wheel due to coin crowding at the base of a collection hopper, or the coin becomes dislodged during rotation, this is equivalent to slowing the rotational sped of the pick up wheel which in turn slows the transactional processing of vehicles through a toll gate system.

In the case of the present invention, coin pick up reliability has been improved by modifications to the geometry of the coin receiving recesses in the pick up wheel. In particular, the removal of the non-chamfered inwardly directed spur-like projection from the junction of the outer edge of the disc and the leading edge of the coin receiving recess seems to have improved coin pick up efficiency.

It readily will be apparent to a person skilled in the art that many modifications and variations are possible with the present invention without departing from the spirit and scope thereof.

Throughout this specification and claims which follow, unless the context requires otherwise, the word ‘comprise’, and variations such as ‘comprises’ or ‘comprising’, will be understood to imply the inclusion of a stated integer or group of integers or steps but not the exclusion of any other integer or group of integers.

What is claimed is:

1. A coin pick up wheel for a coin receiving and validating apparatus, said pick up wheel comprising:

a disc-like body having a plurality of circumferentially spaced coin receiving recesses each recess including a chamfered edge portion extending at least partially about an upper edge thereof, said disc-like body having a central hub portion and an annular outer portion, said pick up wheel characterised in that said disc-like body is formed from a cross linked high molecular weight polyethylene polymer or co-polymer and further characterised in that said annular outer portion tapers convergently towards an outer edge of said disc-like body.

2. The coin pick wheel of claim 1 wherein said central hub portion includes a boss-like projection extending from a lower face thereof.

3. The coin pick up wheel of claim 1 wherein said central hub portion is adapted for mounting to a drive shaft for rotation therewith by at least four equally spaced fasteners extending through said central hub portion.

4. The coin pick up wheel of claim 1 wherein said central hub portion includes a planar upper surface portion.

5. The coin pick up wheel of claim 1 wherein the disc-like body is formed by a machining process.

6. The coin pick up wheel of claim 1 wherein the coin receiving recesses have an inner edge with a thickness in the range of 0.9 mm to 1.3 mm.

7. The coin pick up wheel of claim 1 wherein the coin receiving recesses have an inner edge with a thickness in the range 1.0 mm to 1.2 mm.

8. The coin pick up wheel of claim 1 wherein the coin receiving recesses have an inner edge with a thickness in the range of in the range 1.05 mm to 1.15 mm.

9. The coin pick up wheel of claim 1 wherein the chamfered edge portion of each coin receiving recess extends to an outer edge of said disc-like body at a leading edge of said recess relative to a direction of rotation of said disc-like body.

10. The coin pick up wheel of claim 9 wherein said leading edge is formed at a free end thereof as a tangent to an adjacent arcuate edge portion.

11. The coin pick up wheel of claim 9 wherein a radiussed inner edge portion corresponding to a smallest coin is located adjacent a trailing edge of a coin receiving recess opposite said leading edge.

12. The coin pick up wheel of claim 1 wherein each coin receiving recess comprises a generally concave arcuate inner edge having a plurality of differing radii.

13. The coin pick up wheel of claim 12 wherein the differing radii of each coin receiving recess may have the same or differing points of origin.

14. The coin pick up wheel of claim 12 wherein the differing radii of each coin receiving recess correspond with differing radii of coins receivable by said coin receiving and validating apparatus.

* * * * *